US009444154B2

(12) United States Patent
Suso

(10) Patent No.: US 9,444,154 B2
(45) Date of Patent: Sep. 13, 2016

(54) TERMINAL FITTING-EQUIPPED CONDUCTOR

(71) Applicant: SUMITOMO WIRING SYSTEMS, LTD., Yokkaichi, Mie (JP)

(72) Inventor: Sadamichi Suso, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 23 days.

(21) Appl. No.: 14/471,760

(22) Filed: Aug. 28, 2014

(65) Prior Publication Data

US 2015/0075863 A1 Mar. 19, 2015

(30) Foreign Application Priority Data

Sep. 17, 2013 (JP) ..... 2013-191644

(51) Int. Cl.

*H01R 4/18* (2006.01)
*H01R 4/02* (2006.01)
*H01R 13/02* (2006.01)
*H01R 4/72* (2006.01)

(52) U.S. Cl.

CPC ..... *H01R 4/18* (2013.01); *H01R 4/021* (2013.01); *H01R 4/184* (2013.01); *H01R 13/025* (2013.01); *H01R 4/72* (2013.01)

(58) Field of Classification Search

CPC ..... H01B 7/00; H01B 5/02; H01B 5/12; H01B 7/04; H01R 35/02; H01R 13/03; H01R 13/533; H02G 3/38

USPC ..... 174/74 R

See application file for complete search history.

(56) References Cited

U.S. PATENT DOCUMENTS 3,159,513 A * 12/1964 Baier ..... B29C 61/006 156/294
3,587,030 A * 6/1971 Ohnsorg ..... H01B 5/12 439/502
3,691,505 A * 9/1972 Graves ..... H02G 15/1806 174/78
4,317,277 A * 3/1982 Bennett ..... B23K 11/163 174/94 R
4,576,207 A * 3/1986 Levine ..... B29C 61/0608 138/177
4,922,072 A * 5/1990 Topel ..... B23K 11/002 219/56.1
4,969,269 A * 11/1990 Dominguez ..... B26D 5/16 30/360
4,976,132 A * 12/1990 Shaffer ..... H01R 43/058 29/753
5,541,380 A * 7/1996 Ogden ..... H01R 43/0214 219/56
6,156,873 A * 12/2000 Krause ..... A61K 49/0433 424/1.11
7,374,466 B2 * 5/2008 Onuma ..... H01R 11/28 439/874
2010/0018768 A1 * 1/2010 Takahashi ..... H01R 4/183 174/74 R

FOREIGN PATENT DOCUMENTS

JP A-8-306417 11/1996
JP 2002-184243 * 6/2002
JP 2002-222685 * 8/2002

* cited by examiner

*Primary Examiner* — Michael F McAllister
(74) *Attorney, Agent, or Firm* — Oliff PLC

(57) ABSTRACT

The present disclosure provides a terminal fitting-equipped conductor that has a high level of tensile strength and can achieve stable contact resistance. A terminal fitting-equipped conductor is a terminal fitting-equipped conductor to which a terminal fitting is attached by crimping an end portion of a flexible metal braided portion made of a plurality of metal wires braided together. The wires are fused to each other by resistance welding and a crimped portion is formed at the end portion of the metal braided portion. The crimped portion is crimped to a barrel portion with which the terminal fitting is provided. The wires are mutually bonded by being fused to each other, and fixed. As a result, the crimped state of the crimped portion to the barrel portion is stable.

7 Claims, 3 Drawing Sheets

TERMINAL FITTING-EQUIPPED CONDUCTOR

BACKGROUND

The present disclosure relates to a conductor equipped with a terminal fitting.

JP H8-306417A discloses a technique for connecting battery terminals using a braided wire. The braided wire has good flexibility, and is thus useful when the distance between connecting points that need to be connected is short. According to JP H8-306417A, a metal terminal plate is attached to an end of the braided wire, and the metal terminal plate is connected to a battery post. In recent years, there is an increasing demand for terminal fittings equipped with a barrel portion in place of a terminal plate.

SUMMARY

However, the braided wire is made of a plurality of metal wires braided together. The metal wires therefore easily become loose at end portions of the braided wire and the end portions easily become flared. Accordingly, when crimping is performed on the barrel portion of a terminal fitting, a bare metal wire may be caught between the front ends of the barrel pieces. In this case, the tensile strength is reduced. Also, if the flared braided wire is crimped, a stable crimped state is not obtained. As a result, a problem arises in that the contact resistance becomes unstable.

The present disclosure has been made under the above-described circumstances, and it is an object of the present disclosure to provide a terminal fitting-equipped conductor that has a high level of tensile strength and can achieve stable contact resistance.

A terminal fitting-equipped conductor according to the present disclosure includes a terminal fitting and a flexible metal braided portion made of a plurality of metal wires that are braided together, wherein: the terminal fitting is attached to the metal braided portion by crimping an end portion of the metal braided portion in order to form a crimped portion at the end portion of the metal braided portion, the metal wires are fused to each other, and the crimped portion is crimped to a terminal connection portion with which the terminal fitting is provided.

According to the present disclosure, the wires constituting a metal braided portion are fixed by being fused to each other. It is therefore possible to achieve stable contact resistance with the terminal fitting and an improvement in tensile strength as compared to conventional technology.

BRIEF DESCRIPTION OF THE DRAWINGS

Various exemplary aspects will be described with reference to the drawings wherein.

DETAILED DESCRIPTION OF THE EMBODIMENTS

A preferred embodiment of the present disclosure will be described below.

With a terminal fitting-equipped conductor according to the present disclosure, it is preferable that a metal braided portion has crimped portions at both lengthwise end portions of the metal braided portion, a terminal fitting is attached to each of the crimped portions, and the metal braided portion between the terminal fittings is covered by an insulating member. With this configuration, the insulating member covering the metal braided portion prevents the metal braided portion from corrosion.

It is preferable that the insulating member has a cylindrical shape that allows insertion of the metal braided portion therein, and is made of a material having a shape-retaining function that can change the metal braided portion to a predetermined curved shape.

With this configuration, it is possible to change the metal braided portion to a predetermined curved shape by insertion of the metal braided portion into the insulating member. Accordingly, even when, for example, the terminal fittings attached to both end portions of the metal braided portion are closely spaced to their corresponding connection terminals, because the metal braided portion has been changed (is retained) to a predetermined curved shape in advance, the connecting operation of the terminal fittings can be easily performed.

The insulating member may be a heat-contraction tube configured such that the heat-contraction tube with the metal braided portion inserted therein applies an urging force to the metal braided portion in a direction that causes the metal braided portion to contract in its lengthwise direction, thereby changing the metal braided portion to a predetermined curved shape.

With this configuration, the metal braided portion is inserted in the heat-contraction tube, and thereafter the metal braided portion is bent into a predetermined curved shape. In this state, the heat-contraction tube is heated and caused to contract. Then, the heat-contraction tube applies an urging force that causes the metal braided portion to contract in the lengthwise direction, thereby changing the metal braided portion to a predetermined curved shape. Accordingly, the connecting operation of the terminal fittings can be easily performed.

A terminal fitting-equipped conductor according to Embodiment 1 of the present disclosure will be described with reference to the drawings.

Embodiment 1

Figure 1:
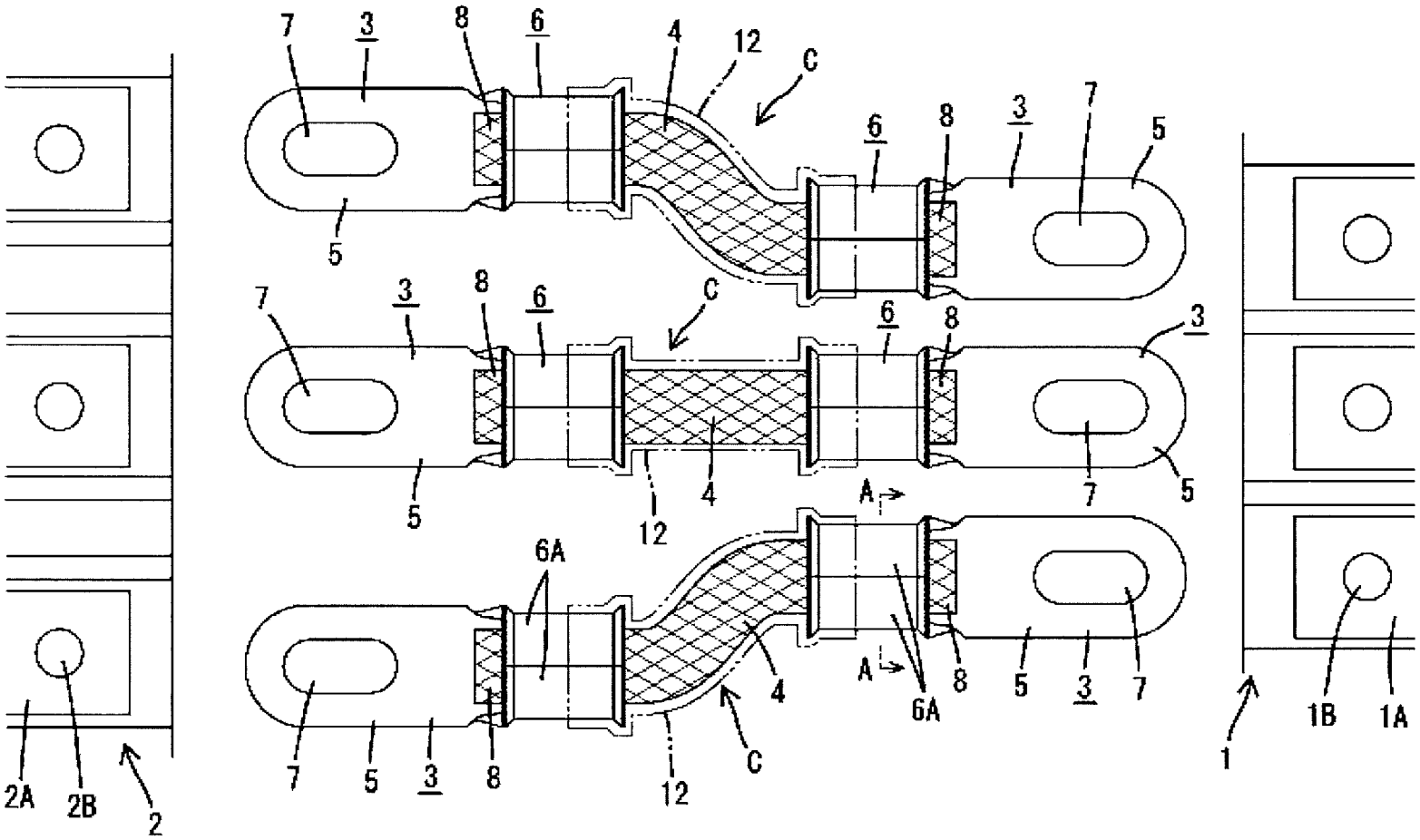
FIG. 1 is a plan view showing a connection state between a motor and a power control unit.

FIG. 1 shows a state in which a motor 1 and a power control unit (PCU) 2 are connected by three terminal fitting-equipped conductors C in a hybrid vehicle or an electric vehicle. As shown in FIG. 1, in the areas where the motor 1 and the PCU 2 oppose each other, three terminal portions 1A and three terminal portions 2A are provided in parallel. The terminal portions 1A on the motor 1 side and the terminal portions 2A on the PCU 2 side that oppose each other are closely spaced with an interval of, for example, about 100 mm. A stud bolt 1B, 2B is provided upright in each terminal portion 1A, 2A shown in FIG. 1.

Each terminal fitting-equipped conductor C includes a pair of terminal fittings 3 provided at the two lengthwise end portions of the terminal fitting-equipped conductor C, and a metal braided portion 4 connecting the terminal fittings 3. Each terminal fitting 3 is formed by bending a sheet made of, for example, a copper alloy.

Each terminal fitting 3 is integrally formed with a terminal connection portion 5 for connecting to a terminal portion 1A on the motor 1 side or a terminal portion 2A on the PCU 2 side, and a barrel portion 6 for connecting to the metal braided portion 4. Each terminal connection portion 5 has a receiving hole 7, which is a long hole extending in the lengthwise direction and penetrating through the terminal connection portion 5, and is capable of receiving an inserted stud bolt 1B of the terminal portion 1A on the motor 1 side or an inserted stud bolt 2B of the terminal portion 2A on the PCU 2 side. By tightening nuts (not shown) with the stud bolts 1B and 2B being inserted in the receiving holes 7 of the terminal connection portions 5, an electrical connection is established between the terminal fitting-equipped conductors C and the terminal portions 1A and 2A. Each barrel portion 6 has a bottom extending flush from the bottom of the terminal connection portion 5, and is composed of a pair of barrel pieces 6A extending in the width direction from both edges of that bottom. The barrel pieces 6A can be connected to a metal braided portion 4 by crimping the end portion of the metal braided portion 4.

Figure 3A:
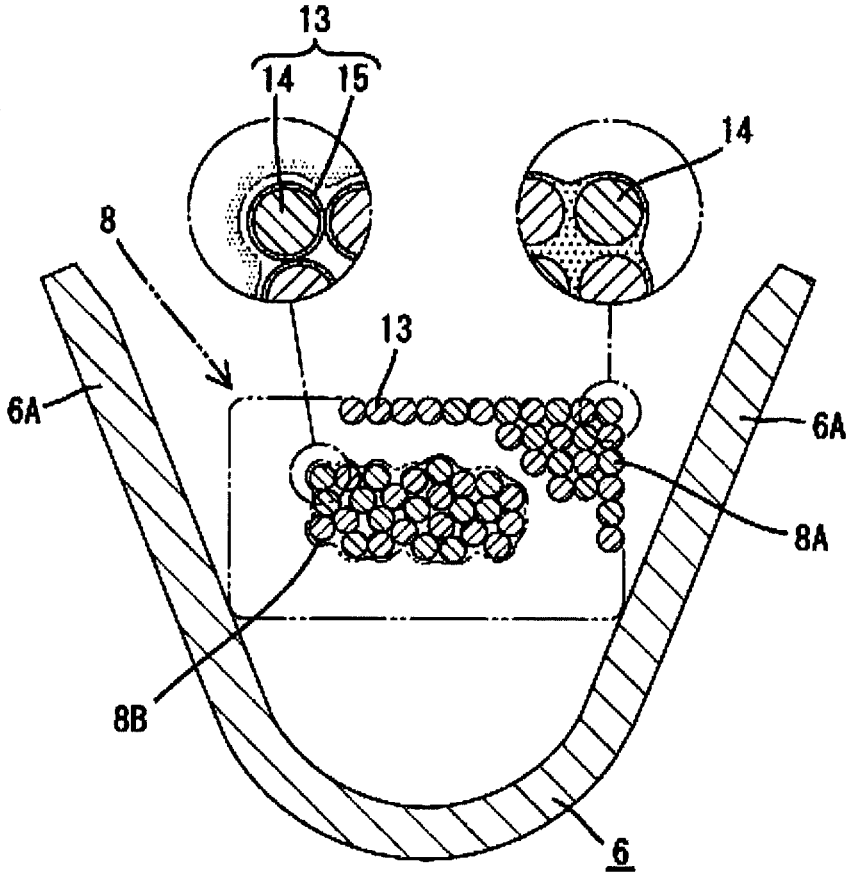
FIG. 3A is a cross-sectional view taken along the line A-A shown in FIG. 1 before crimping.

The metal braided portion 4 is made of a braided metal wire H formed by braiding a plurality of metal wires 13 into a mesh cylinder, and thus has good flexibility. As shown in FIG. 3A, each metal wire 13 is made of, for example, a core 14 made of a copper-based metal and a tin-plate layer 15 provided on the surface of the core 14. The metal braided portion 4 has, at each lengthwise end portion, a crimped portion 8 that is crimped by the barrel portion 6 of a terminal fitting 3.

The crimped portion 8 is formed by performing resistance welding on an area with a predetermined length from the end of the metal braided portion 4 so as to fuse the wires 13 to each other. That is, in the area of the metal braided portion 4 on which resistance welding has been performed, as shown in the right enlarged view of FIG. 3A, in each wire 13 located on a periphery of the crimped portion 8, the tin-plate layer 15 on the surface of the core 14 of the wire 13 melts with the core 14 remaining unmelted, thereby forming a fused region 8A where the wires 13 located on the periphery are bonded to each other. The core 14 of each wire 13 retains its circular cross section. Therefore, as a result of the wires 13 located on the periphery of the crimped portion 8 being bonded to each other, the wires 13 do not come loose. In addition, the spaces between the wires 13 are substantially filled with the melted tin component, and thus there is almost no vacant space.

On the other hand, heat from resistance welding is poorly conducted to a center portion of the crimped portion 8. For this reason, a large part of the tin-plate layer 15 of each wire 13 remains unmelted, thus creating a void-containing region 8B in the center portion of the crimped portion 8, the void-containing region 8B having a large number of voids distributed between the wires 13. Note that the voids in the void-containing region 8B will be substantially filled (see the left enlarged view of FIG. 3B) because the wires 13 are compressed and brought closer together by crimping by the barrel portion 6. That is, the void-containing region 8B functions to allow the crimped portion 8 to reduce its diameter. In this way, the crimped portion 8 takes a narrowed form (diameter-reduced form) with respect to a general portion on which resistance welding is not performed. Also, the crimped portion 8 is formed in a plate-like shape having a size that can be set inside the barrel portion 6, and is formed so as to be slightly longer than the length of the barrel portion 6.

A process for manufacturing a metal braided portion 4 will be described in detail next. The end face of each crimped portion 8 is a cut end face, and the end face is fixed so that the ends of the wires 13 will not come loose.

Figure 2:
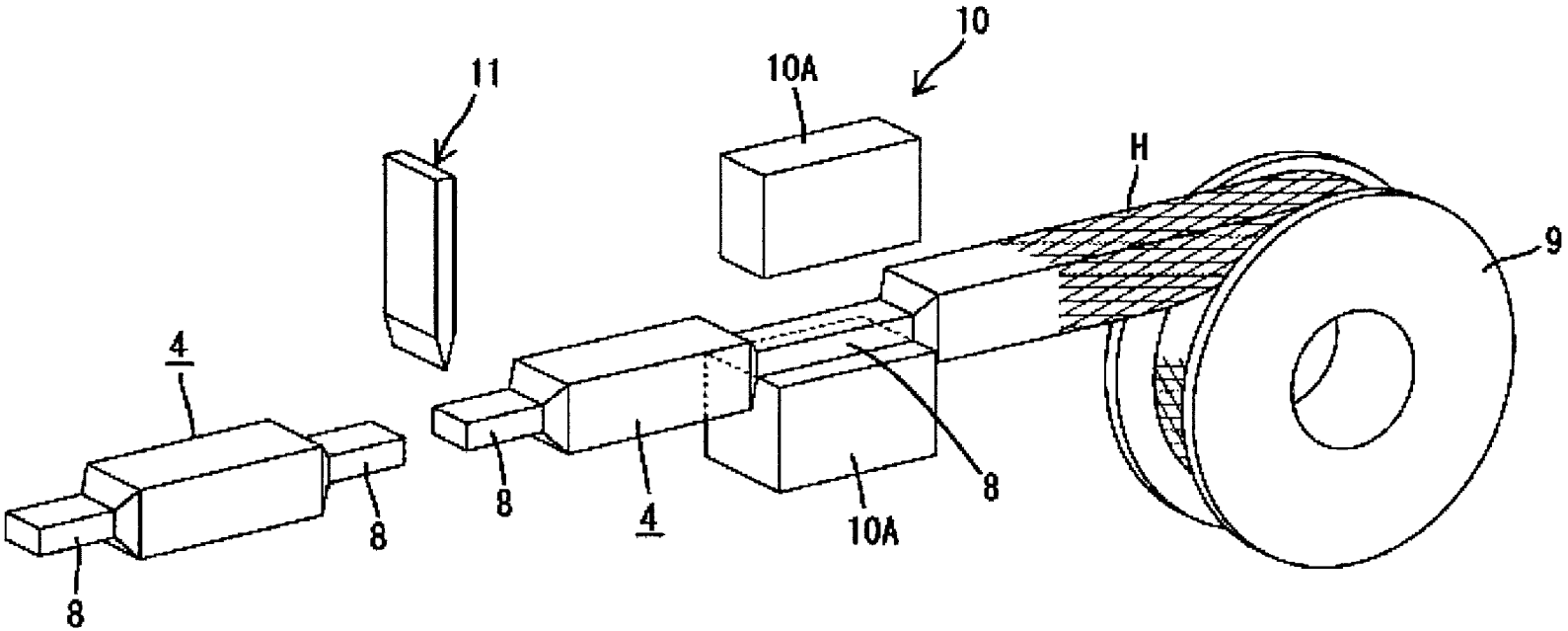
FIG. 2 is a diagram showing a process for manufacturing a terminal fitting-equipped conductor.

FIG. 2 shows a process for manufacturing a metal braided portion 4. In an upstream part of the manufacturing line, a reel 9 around which a braided metal wire H braided as a single continuous body is wound is provided. The braided metal wire H is sequentially reeled out from the reel 9. The reeled-out braided metal wire H is then subjected to a fusing step using a resistance welding machine 10.

The resistance welding machine 10 includes a pair of opposing welding electrodes 10A. When the braided metal wire H is sandwiched and pressurized by the pair of welding electrodes 10A in the vertical direction in the diagram, and a welding current is applied in this state, only the tin-plate layer 15 of the wires 13 at the periphery of the braided metal wire H melts. Due to the melted tin component, the wires 13 are substantially bonded, forming the aforementioned fused region 8A (see the right enlarged view of FIG. 3A). In contrast, in the center portion, heat from the resistance welding is poorly conducted as compared to the periphery. Accordingly, the tin-plate layer 15 of each wire 13 hardly melts, and as a result, a large part of the wires 13 maintain their shape. Therefore, in the center portion of the area that has undergone resistance welding, voids are formed between the wires 13, and thereby the aforementioned void-containing region 8B is formed (see the left enlarged view of FIG. 3A).

If the fusion is formed by resistance welding, the fused portion extends in the lengthwise direction over at least twice the length of the crimped portion 8. Then, after completion of resistance welding, the braided metal wire H is moved forward by a predetermined stroke (corresponding to the length of the general portion of the metal braided portion 4), and after the moving operation, the next resistance welding operation is performed.

A cutter device 11 is provided downstream of the resistance welding machine 10. The portion fused by the resistance welding machine 10 is cut substantially along a center thereof by the cutter device 11. By doing so, a metal braided portion 4 having a crimped portion 8 at each lengthwise end portion is obtained. The metal braided portion 4 is then subjected to a step of connecting to terminal fittings 3. In this step, the metal braided portion 4 is inserted into a heat-contraction tube 12 for protecting the metal braided portion 4. Note that, however, at the time of crimping the crimped portion 8 to the barrel portion 6 of the terminal fitting 3, the heat-contraction tube 12 needs to be slightly displaced so as to not interrupt the crimping operation.

Figure 3B:
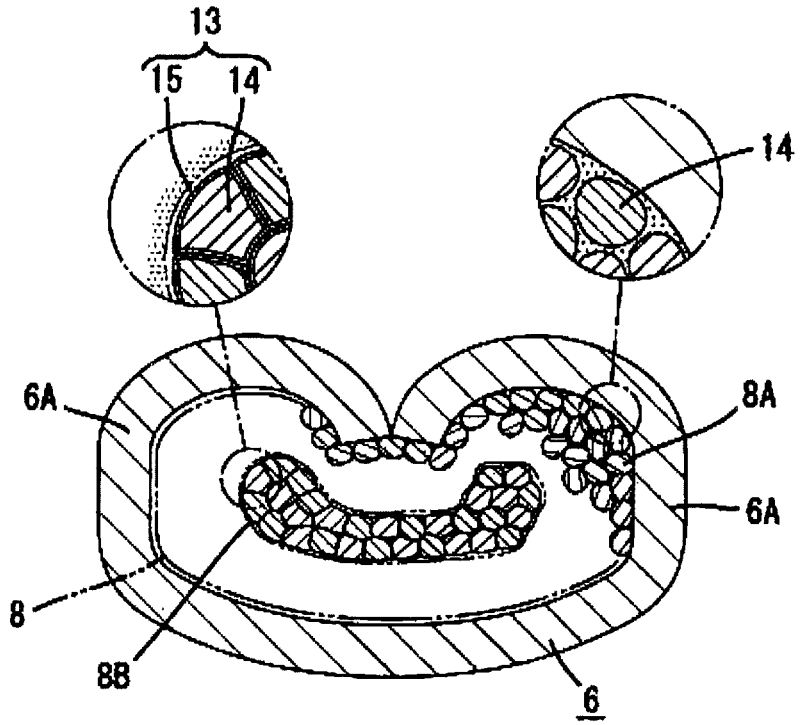
FIG. 3B is a cross-sectional view taken along the line A-A shown in FIG. 1 after crimping.

In the crimping operation, as shown in FIG. 3B, the crimped portion 8 is set inside the barrel portion 6, and then crimped such that the front ends of the barrel pieces 6A abut against each other. By doing so, the fused region 8A of the crimped portion 8 is deformed to conform to the inner circumferential shape of the barrel pieces 6A. In the void-containing region 8B, each wire 13 is compressed and deformed, whereby the voids between the wires 13 are filled (see the left enlarged view of FIG. 3B). As a result, the entire crimped portion 8 is reduced in size with respect to the general portion.

After completion of the crimping operation on the crimped portion 8 in the mariner described above, the heat-contraction tube 12 is moved to such a position that it can cover the area between the barrel portions 6 of two terminal fittings 3. Then, as shown in FIG. 1, the metal braided portion 4 provided in the one of the three terminal fitting-equipped conductors C for connecting the motor 1 and the PCU 2 that is provided at the center remains in a straight shape, whereas the metal braided portions 4 provided in the terminal fitting-equipped conductors C that are provided to the sides are curved and deformed in a predetermined shape together with the heat-contraction tubes 12.

After that, each heat-contraction tube 12 is heat-contracted by application of heat, whereby the heat-contraction tube 12 covers the metal braided portion 4 between two barrel portions 6, while being in close contact with the outer surface of the metal braided portion 4. By doing so, the heat-contraction tube 12, due to its contractive force, urges the metal braided portion 4 to be pulled in the lengthwise direction, and thus the curved shape can be maintained. In other words, a predetermined curved shape can be retained. Accordingly, because the terminal fitting-equipped conductor C obtained in the manner described above can retain a predetermined curved shape, the interval between the terminal portions 1A and 2A on the motor 1 side and the PCU 2 side can be shortened, and thus a favorable effect is exerted particularly in an environment where a large force is required to bend the metal braided portion 4.

The terminal fitting-equipped conductor C configured as described above has the following advantageous effects.

(1) As shown in FIG. 1, each terminal fitting-equipped conductor C is placed so as to extend between the corresponding terminal portions 1A and 2A respectively provided on the motor 1 and the PCU 2, and stud bolts are respectively inserted into the receiving holes 7 of the terminal fittings 3 and tightened with nuts (not shown). By doing so, an electrical connection is established between the corresponding terminal portions 1A and 2A respectively provided on the motor 1 and the PCU 2. As described above, although the distance between the corresponding terminal portions 1A and 2A respectively provided on the motor 1 and the PCU 2 is short, the metal braided portion 4 and the heat-contraction tube 12 both have good flexibility, and thus the closely positioned terminal portions 1A and 2A can be easily connected.

(2) By performing resistance welding on both end portions of the metal braided portion 4, the wires 13 located on the periphery are fused to each other and fixed. Accordingly, the wires 13 will not come loose as in conventional technology, and thus the crimped portion 8 can be stably crimped to the barrel portion 6. It is therefore possible to increase the tensile strength, and the contact resistance between the crimped portion 8 and the barrel portion 6 can be stabilized.

(3) Furthermore, the spaces between wires 13 in the center portion of the crimped portion 8 are filled without vacant space, contributing to a reduction in electrical resistance.

(4) Furthermore, the metal braided portion 4 is made of a continuous body of braided metal wire H, and thus two crimped portions 8 can be formed simultaneously with a single instance of welding operation on condition that cutting is subsequently performed. It is therefore possible to increase the manufacturing efficiency of the metal braided portion 4.

Other Embodiments

The present disclosure is not limited to the embodiment described above with reference to the drawings, and, for example, the following embodiments also fall within the technical scope of the present disclosure.

(1) In the embodiment described above, both end portions of the metal braided portion 4 are subjected to resistance welding in order to form crimped portions 8, but the crimped portions 8 may be formed by ultrasonic welding instead of resistance welding. In this case, it is desirable that the tin coating plated on the surface of each wire 13 is removed in advance.

(2) In the embodiment described above, the metal braided portion is formed by performing thermal fusion on the continuous body of braided metal wire H and cutting the continuous body into a predetermined length, but it is also possible to cut the continuous body into a predetermined length in advance, and then perform thermal fusion on the resulting cut pieces.

(3) In the embodiment described above, the terminal fitting-equipped conductor C according to the present disclosure is used to establish an electrical connection between the motor 1 and the PCU 2, but the site of use is not limited thereto.

(4) In the embodiment described above, terminal fittings 3 of the same type are attached to both ends of the metal braided portion 4, but terminal fittings of different types may be attached.

What is claimed is:

1. A terminal fitting-equipped conductor comprising:
- a terminal fitting; and
- a flexible metal braided portion made of a plurality of metal wires that are braided together, wherein:
  - the terminal fitting is integrally formed with a terminal connection portion and a barrel portion as a single piece structure,
  - the terminal fitting is attached to the metal braided portion by crimping an end portion of the metal braided portion in order to form a crimped portion at the end portion of the metal braided portion, and the barrel portion further crimps the crimped portion in order to reduce voids at a center portion of the crimped portion, and
  - the metal wires are fused to each other.

2. The terminal fitting-equipped conductor according to claim 1, wherein
- the metal braided portion has the crimped portion at each lengthwise end portion of the metal braided portion,
- the terminal fitting includes a terminal fitting attached to each of the crimped portions, and
- the metal braided portion between the terminal fittings is covered with an insulating member.

3. The terminal fitting-equipped conductor according to claim 2, wherein the insulating member has a cylindrical shape into which the metal braided portion can be inserted, and is made of a material having a shape-retaining function that can change the metal braided portion to a predetermined curved shape.

4. The terminal fitting-equipped conductor according to claim 3, wherein the insulating member is a heat-contraction tube configured such that the heat-contraction tube with the metal braided portion inserted therein applies an urging force to the metal braided portion in a direction that causes the metal braided portion to contract in its lengthwise direction, thereby retaining the metal braided portion in the predetermined curved shape.

5. The terminal fitting-equipped conductor according to claim 1, wherein each metal wire includes a core made of a copper-based metal and a tin-plate layer provided on a surface of the core.

6. The terminal fitting-equipped conductor according to claim 5, wherein a fused region is formed at the crimped portion in which the tin-plate layer has melted for the metal wires at a periphery of the flexible metal braided portion by welding.

7. The terminal fitting-equipped conductor according to claim 1, wherein a fused region is formed at the crimped portion at a periphery of the flexible metal braided portion by welding.

* * * * *